United States Patent [19]

Spinks et al.

[11] Patent Number: 4,922,664

[45] Date of Patent: May 8, 1990

[54] LIQUID SAND BLAST NOZZLE AND METHOD OF USING SAME

[75] Inventors: Arthur L. Spinks; Jerry P. Woodson, both of Houston, Tex.

[73] Assignee: Whitemetal Inc., Houston, Tex.

[21] Appl. No.: 274,620

[22] Filed: Nov. 22, 1988

Related U.S. Application Data

[63] Continuation of Ser. No. 49,015, May 6, 1987, abandoned, which is a continuation of Ser. No. 739,500, May 30, 1985, abandoned, which is a continuation of Ser. No. 446,393, Dec. 2, 1982, abandoned.

[51] Int. Cl.[5] ..... B24C 5/04

[52] U.S. Cl. ..... 51/321; 51/436; 51/439; 51/427; 239/63

[58] Field of Search ..... 51/415, 427, 428, 436, 51/438, 439, 411, 319–321; 239/63, 74; 73/168

[56] References Cited

U.S. PATENT DOCUMENTS

| | | | |
|---|---|---|---|
| 839,483 | 12/1906 | Kelly | 51/439 |
| 998,762 | 7/1911 | Faller . | |
| 1,170,198 | 2/1916 | Sweet et al. . | |
| 1,476,619 | 12/1923 | Kemp et al. . | |
| 1,905,698 | 4/1933 | Fulton . | |
| 2,089,597 | 8/1937 | Carter | 51/439 X |
| 2,117,648 | 5/1938 | Bottorf | 51/411 |
| 2,413,167 | 12/1946 | Bugley | 51/439 |
| 2,503,743 | 4/1950 | Keefer . | |
| 2,543,517 | 2/1951 | Anderson . | |
| 2,594,735 | 4/1952 | Crumley . | |
| 2,821,346 | 1/1958 | Fisher . | |
| 3,047,986 | 8/1962 | McKulla, Jr. . | |
| 3,100,724 | 8/1963 | Rocheville . | |
| 3,559,344 | 2/1971 | Peterson . | |
| 3,646,709 | 3/1972 | Nolan | 51/427 |
| 3,858,358 | 1/1975 | Stachowiak et al. | 51/427 |
| 3,994,097 | 11/1976 | Lamb | 51/439 |
| 4,048,757 | 9/1977 | Kubus et al. | 51/436 |
| 4,218,855 | 8/1980 | Wemmer . | |
| 4,430,886 | 2/1984 | Rood | 73/168 X |
| 4,449,332 | 5/1984 | Griffiths | 51/439 |

FOREIGN PATENT DOCUMENTS

| | | |
|---|---|---|
| 168863 | 6/1903 | Fed. Rep. of Germany . |
| 7928593 | 11/1979 | France . |
| 331919 | 8/1958 | Switzerland . |
| 221534 | 4/1969 | U.S.S.R. . |

*Primary Examiner*—Robert P. Olszewski
*Attorney, Agent, or Firm*—Dodge, Bush & Moseley

[57] ABSTRACT

A method and apparatus is disclosed for using a nozzle to propel abrasive particles with high pressure water. The nozzle has a straight line path for a constant flow rate of air and abrasive particles to a propulsion chamber. A water path through the nozzle also opens into the propulsion chamber, with both the abrasive path and water path intersecting in the chamber. An outlet bore is provided through the nozzle and communicates with the chamber. A high pressure water supply is used and an air and abrasive supply means independent of the water supply is used to deliver a constant flow of air and abrasive particles. The water inlet path accelerates the water in a propelling jet toward and in alignment with the outlet bore so as to impact the abrasive particles and create a high energy abrasive blast through the outlet bore.

8 Claims, 2 Drawing Sheets

LIQUID SAND BLAST NOZZLE AND METHOD OF USING SAME

This application is a continuation of application Ser. No. 049,015, filed 5/6/87 which is a continuation of Ser. No. 739,500, filed May 30, 1985, which is a continuation of Ser. No. 446,393, filed Dec. 2, 1982 all now abandoned.

FIELD OF THE INVENTION

The invention relates to apparatus which applies a pressurized flow of abrasives to clean and prepare a surface. More particularly, the invention relates to sand blast nozzles for use in cleaning a surface with a pressurized stream of liquid and sand.

BACKGROUND OF THE INVENTION

The use of a pressurized flow of abrasives to clean a surface has been common for many years. In the past, two types of devices have been used to accelerate the abrasive against a surface. One type of apparatus feeds the abrasive into a high speed rotating wheel similar to a centrifugal fan. As the abrasive slides along the vanes of the wheel, it is accelerated and propelled against the object to be cleaned.

The second type of device uses compressed gas, normally air, to transport the abrasive through pipes and hoses. In this type of device, the compressed air used to transport the abrasive is expanded through a nozzle at the end of a pipe or hose and accelerates the abrasive against the object to be cleaned. In some devices, additional air is fed into the nozzle to assist in accelerating the abrasive.

Within the last ten years or so, devices which use water as a cleaning agent have been introduced in one form or another. Loosely termed "hydroblasters", these devices include units which use only water under very high pressure and also units which use water in connection with an abrasive. This application focuses on the second type of hydroblaster which uses a liquid propellant and an abrasive to clean the surface of an object.

An example of this second type of hydroblaster is shown in U.S. Pat. No. 4,218,855 to Wemmer which discloses a particulate spray nozzle for use with water and sand. As is believed to be common of most water-sand hydroblasters, Wemmer uses the flow of the water to create a vacuum to draw the abrasive into the flow and out against the surface. In particular, Wemmer states that the "liquid pressure nozzle disclosed cooperates with the discharge bore of the blasting nozzle to create a full vacuum in the mixing chamber while at the same time maximizing impact velocity of the propellant and particulate mixture." Column 2, lines 23–28. It is believed that the devices similar to Wemmer which depend upon the creation of an adequate vacuum to cause particulate flow, however, are dependent upon very precise control of the spread of the liquid spray and the shape of the discharge bore to create and theoretically maintain the vacuum. If pressures of several thousand PSI are used, however, very slight changes in the shape of the orifice as well as changes in the discharge bore will cause the vacuum in the mixing chamber to change and thus also change the abrasive flow per unit of time. Because of the tendency of water under pressure to cause such erosive changes, personal experience has shown that abrasive flow control dependent upon a vacuum is difficult at best.

Even assuming that a constant vacuum is possible, such vacuum still may not be adequate for some purposes. Wemmer states that the interrelationship between the discharge bore and the spray stream may produce a full vacuum of up to and exceeding thirty (30) inches of mercury relative to ambient pressure. Column 3, lines 9–12. It is believed that this differential pressure is insufficient to consistently transport many materials whose particle sizes are desirable as good abrasives (16 to 40 mesh, materials). It is therefore the present inventor's experience that the utilization of a vacuum to cause abrasive flow has proven to be inadequate for many cleaning applications.

Attempts to provide a suitable nozzle which induces abrasive flow by other than vacuum force, however, have encountered numerous problems. The greatest problem is the rapid destruction of nozzles caused by improperly feeding the abrasive into the liquid propellant stream. Another problem is caused by wetting of the abrasive such that it clogs the nozzle.

It is therefore an object of the present invention to provide a new and improved system for use in treating a surface by propelling an abrasive against the surface with a liquid propellant which induces abrasive flow for the larger particle size abrasives and which will not rapidly destroy or clog the nozzle.

SUMMARY OF THE INVENTION

Accordingly, a liquid sand blast nozzle system is provided for use in treating a surface by propelling an abrasive against the surface with a liquid (usually water-based) propellant. The system includes a nozzle having a housing defined by a reference axis extending from a first side of the housing to the opposing, second side of the housing. The reference axis is typically oriented substantially parallel to the surface to be cleaned.

The housing has a propellant inlet bore extending inwardly from the first side of the housing wherein the propellant inlet bore defines a first end of an axis of propulsion angularly disposed to the reference axis at an acute angle. The housing also includes a propellant outlet bore extending inwardly from the second side of the housing in substantially coaxial alignment with the propellant inlet bore along the propulsion axis. The housing further includes a propulsion chamber disposed inside the housing between the propellant inlet bore and the propellant outlet bore and adapted to provide coaxial communication of a propellant from the inlet bore to and through the outlet bore.

An abrasive feed bore extends inwardly from the outside of the housing to the propulsion chamber such that the abrasive feed bore defines a feed axis angularly disposed at an acute angle to the first end of the propulsion axis. The abrasive feed bore enters the propulsion chamber at a point such that substantially all flow of an abrasive through the feed bore enters the propulsion chamber before reaching the intersection of the propellant outlet bore and the propulsion chamber, and thereby makes only one change in direction in operation.

The nozzle further includes a means disposed in the propellant inlet bore for directionally accelerating such a propellant. The means is positioned to direct propellant through the propellant inlet bore and the propellant outlet bore in substantial alignment with propulsion axis.

A means for supplying a liquid under a predetermined pressure to the propellant inlet bore is operatively associated with the nozzle. The pressurized liquid supply means is thereby adapted to provide the primary propellant for the system.

The system further includes a pressurized means for supplying an abrasive at a predetermined feed rate to the abrasive feed bore. The pressurized abrasive supply means is adapted to supply a substantially constant flow of abrasive into the propellant flow, regardless of the vacuum created by the propellant flow and regardless of the size of the abrasive.

In a preferred embodiment of the present invention, the pressurized liquid supply means includes a high pressure pump having an outlet operatively associated with the propellant inlet bore to supply a propellant under pressure. The pressurized abrasive supply means includes a pressure vessel comprising a reservoir suitable for holding a desired quantity of abrasive. The pressure vessel is pressurized to a pressure suitable for supplying an abrasive at a transport velocity of between 3,000 and 20,000 feet per minute, and preferably 4,000 to 5,000 feet per minute.

In a more preferred embodiment of the present invention, the propellant inlet bore of the nozzle defines an axis of propulsion angularly disposed to the referenced axis at an angle between 20° and 50° . It has especially been found that the optimum angle is substantially 30°.

In a still more preferred embodiment of the present invention, the nozzle includes a removable wear liner mounted in the propellant outlet bore wherein the liner has a wear bore extending therethrough disposed such that the wear bore substantially aligns with the propulsion axis in use.

In yet another preferred embodiment of the present invention, the accelerating means of the nozzle includes a nozzling member having a tapered bore extending therethrough, wherein the exterior shape of the nozzling member and the interior shape of the propellant inlet bore have complementing configurations adapted to positively engage and orient the nozzling member in the inlet bore such that the nozzling member directs propellant through the propellant inlet bore and the propellant outlet bore in substantial alignment with the propulsion axis.

Hence, the present invention provides a system which supplies abrasive under pressure to a suitable nozzle, thereby overcoming the disadvantages of relying upon a vacuum for constant abrasive flow.

The present invention also provides a nozzle having an improved configuration to accommodate the flow of very highly pressured propellant and abrasive therethrough. The nozzle also provides the feature of replaceable wear liners for both the propellant and abrasive to enhance the life of the nozzle.

BRIEF DESCRIPTION OF THE DRAWINGS

This invention will be further understood with illustrated by reference to the appended drawings which illustrate a particular embodiment of the nozzle and the liquid-sand blast system in accordance with the present invention.

DETAILED DESCRIPTION OF THE PREFERRED EMBODIMENT

Figure 3:
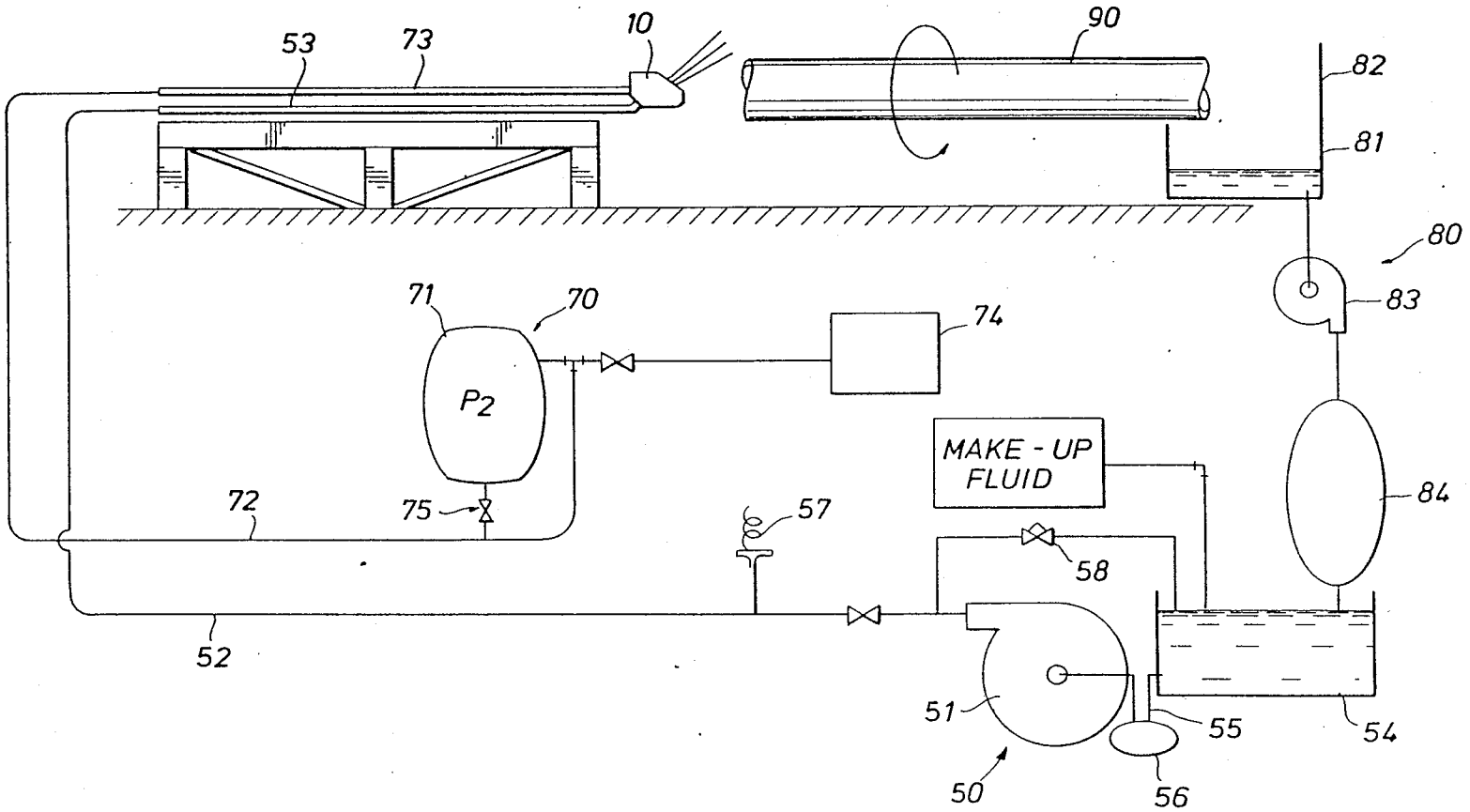
FIG. 3 is a schematic view of the liquid-sand blast system of the present invention.

The preferred embodiment is generally represented in FIG. 3 by a nozzle 10 which is in fluid communication with a liquid supply means 50 and an abrasive supply means 70.

Figure 2:
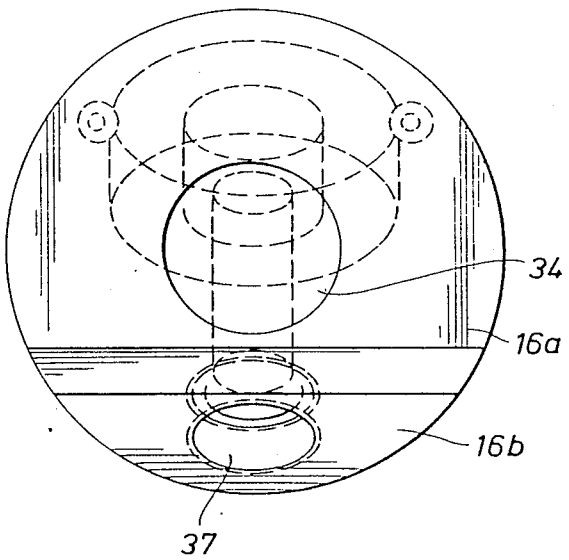
FIG. 2 is an end view of the nozzle shown in FIG. 1.
Figure 1:
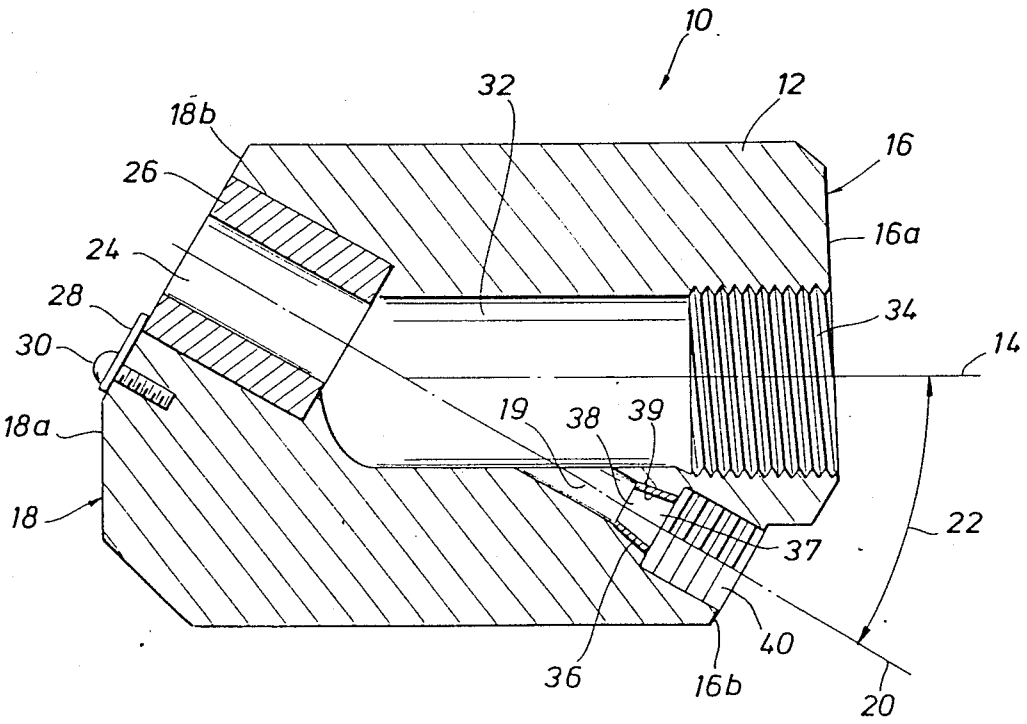
FIG. 1 is a sectional view of a nozzle in accordance with the present invention.

Referring to FIGS. 1 and 2, the nozzle 10 includes a housing 12 which, in the preferred embodiment, has a cylindrical configuration and is defined by a reference axis 14 extending along the axis of the cylinder from a first end 16 of the housing 12 to the opposing second end 18 of the housing 12. The first end 16 includes two faces or sections: an abrasive supply face **16*a*, which is disposed in the preferred embodiment substantially perpendicular to the reference axis 14, and a propellant supply face 16*b*, which is disposed in the preferred embodiment at an angle of substantially 60° to the reference axis 14. The second end 18 also includes two faces or sections: a blank face 18*a*, which is disposed in the preferred embodiment substantially perpendicular to the reference axis 14 and a propellant exit face 18*b*, which is disposed in the preferred embodiment parallel to the propellant supply face 16*b***.

The housing 12 further includes a propellant inlet bore 19, which extends inwardly from the propellant supply face **16*b* of the housing 12 and a propellant outlet bore 24, which extends inwardly from the propellant exit face 18*b* of the housing 12. The propellant inlet bore 19 and propellant outlet bore 24 are coaxially aligned and define an axis of propulsion 20 which is angularly disposed to the reference axis 14 at a predetermined angle 22. In the preferred embodiment, the angle 22** is substantially 30°. It will be understood, however, that other acute angles may be utilized in accordance with the present invention.

It should be noted that the reference axis 14 represents that typical orientation of the nozzle which is substantially parallel to the surface to be cleaned. Hence, while in the preferred embodiment the housing has a generally cylindrical configuration wherein the reference axis 14 extends from one end of the cylinder to the other along the axis of the cylinder, it should be understood that other shapes for the housing may be utilized so long as the above-described relationship between a reference axis 14 and the axis of propulsion 20 is maintained.

The propellant outlet bore 24 may further include a removable wear liner 26 mounted therein. In the preferred embodiment, the liner 26 has a cylindrical configuration having an inner bore of predetermined diameter extending therethrough whereby the walls of the liner 26 accommodate wear during use. The liner 26 is typically comprised of tungsten carbide or other suitable material resistant to erosion by abrasives and/or high pressure water flow. The removable liner 26 may be held in place by a locking tab 28 secured to the housing by a screw 30 or other suitable means. The nozzle 10 of the present invention thereby includes a means for replacing the liner 26 as it wears in order to increase the life of the nozzle 10.

The housing 12 further has a propulsion chamber 32 disposed within the housing 12 between the propellant inlet bore 19 and the propellant outlet bore 24. The propulsion chamber 32 is adapted to provide coaxial communication of a propellant from the inlet bore 19 to and through the outlet bore 24. An abrasive feed bore 34 extends inwardly from the abrasive supply face **16*a*** to communicate with the propulsion chamber 32. The abrasive feed bore 34 is disposed such that it enters the propulsion chamber 32 at a point wherein substantially all flow of an abrasive through the feed bore 34 enters the propulsion chamber 32 before reaching the intersection of the propellant outlet bore 24 and the propulsion chamber 32 such that abrasive passing through the bore 34 makes only one change in direction after it enters the bore 32 in operation.

The abrasive feed bore 34 defines a feed axis angularly disposed with respect to the propulsion axis 20. In the preferred embodiment, the feed axis and the reference axis 14 are identical. It will be understood, however, that other directions of feed may be utilized in accordance with the present invention.

The nozzle 10 further includes a means disposed in the propellant inlet bore 19 for directionally accelerating a propellant. The means is positioned to accelerate propellant through the propellant inlet bore 19 and propellant outlet bore 24 in substantial alignment with the propulsion axis 20. In the preferred embodiment, the accelerating means includes a nozzling member 36 having a shape defined by a truncated cone with a tapered bore extending therethrough, wherein the outlet 38 of the nozzle member 36 has a selectively smaller cross-sectional area than the inlet 37 of the nozzle 36. The propellant inlet bore 19 includes complementing tapered surface 39 adapted to positively engage the exterior shape of the nozzling member 36 in the inlet bore 19 such that the nozzling member 36 is wedged in position to form a high pressure liquid seal around the member 36 and to accelerate propellant through the propellant inlet bore 19 and the propellant outlet bore 24.

In the preferred embodiment, the propellant inlet bore 19 further includes a threaded section 40 which extends to a point immediately adjacent the nozzle member 36 when the member 36 is in place. The threaded section 40 includes cylindrical threads which are fine enough such that upon the insertion of a high pressure threaded male line member (not shown) into the threaded section 40, the male member may act to hold the nozzle member 36 securely in place without any play. Wear of the nozzle member 36 due to its inadvertant shifting out of position is thereby minimized.

Referring again to FIG. 3, the liquid supply means 50 of the liquid-sand blast system includes a high pressure pump 51 connected on its high side in liquid communication with the propellant inlet 19 by a flexible high pressure liquid line 52 and a rigid high pressure lance 53 and connected on its low side with a water supply source 54 such as a water reservoir by a water feed line 55 having a filter 56 disposed within the line 55 between the source 54 and the pump 51. In the preferred embodiment, the high pressure pump 51 is comprised of a hydraulic pump capable of supplying a liquid to the propellant inlet 19 at approximately 10,000 PSI. It should be understood that the high pressure pump 51 may comprise any of a number of commercially available pumps capable of supplying a liquid at a high pressure, preferably between 1,000 PSI and 20,000 PSI.

The liquid supply means 50 may further include a means for monitoring the wear to the nozzling member 36. In the preferred embodiment, the means includes a pressure switch 57 adapted to the line 52 to monitor the pressure within the line 52. As the nozzling member 36 wears, the pressure in line 52 will correspondingly drop. When the pressure drops below a preselected value, the switch 57 signals the operator that the nozzling insert 36 should be replaced. In the preferred embodiment, the pressure switch 57 is adapted to shut down the system at a given minimum pressure.

The liquid supply means 50 may further include a pressure relief bypass 58 disposed between the high side of the pump 51 and the source 54 to maintain consistent pressure to the nozzle 10 at a level just above the setting for the pressure switch 57. In particular, the relief bypass 58 operates to vent pressurized liquid from line 52 to maintain a consistent preselected pressure within the line 52 during the early wear of the nozzling insert 36. Once the nozzling insert 36 member wears sufficiently to drop the pressure to the level of the bypass 58, the bypass 58 totally closes to direct all pressure to the line 52. The bypass 58 remains closed until a new nozzling member 36 is inserted to again increase the pressure.

Referring still to FIG. 3, the abrasive supply means 70, in the preferred embodiment, includes a pressure vessel 71 connected at its discharge point in communication with the abrasive supply bore 34 by a flexible abrasive transport line 72 and a rigid abrasive transport lance 73. The pressure vessel 71 is connected to a compressed air source 74 adapted to supply pressurized air to the vessel 71. The pressure vessel 71 may comprise any of a number of commercially available pressure vessels having a capability when connected with suitable piping and valving of maintaining a pressure sufficient to provide a substantially constant transport velocity of air and abrasive in the abrasive transport lines within the range of 3,000 feet per minute to 20,000 feet per minute. The flow of abrasive into the lines 72 and 73 is controlled by a metering valve 75 disposed adjacent the discharge of the vessel 71. The flow of air to achieve the transport velocity in lines 72 and 73 is controlled by metering valve 76.

Hence, the abrasive supply means 70 accommodates the controlled flow of abrasive at a preselected rate which is independent of the vacuum created by the nozzle 10. The means 70 thereby permits the use of lengths of supply lines 72 and 73 which had previously not been feasible because the differential pressure created by the use of only a vacuum was inadequate to maintain the transport velocity within the long lines.

In the preferred embodiment, the velocity of the abrasive is generally maintained at 4,000 to 5,000 feet per minute. It will be understood, however, other flow rates may be utilized in accordance with the present invention.

Referring still to FIG. 3, the liquid sand-blast system may also include a liquid reclaim system 80. In the preferred embodiment, the liquid reclaim system 80 comprises of reservoir 81 having shrouding 82 adapted to collect liquid propellant and abrasive after it strikes a workpiece 90. The mixture is then pumped by a transfer pump 83 or flows by gravity through a filtration system 84 where the propelling liquid and abrasive are separated. The reclaimed liquid propellant may then be returned to the reservoir 54 for reuse in the system. Similarly, the reclaimed abrasive may be gathered and treated for reuse if desired.

Operation

Accordingly, in operation, a liquid propellant is fed from the reservoir 54 by the high pressure pump 51 through supply lines 52 and 53 into the propellant inlet bore 19. Upon entering the bore 19, the propellant is further accelerated and directed by the nozzle member 36 along the propulsion axis 20 into the propulsion chamber 32. Abrasive is simultaneously fed by means of the pressure vessel 71 into the abrasive supply lines 72 and 73, through the abrasive feed bore 34, and into the propulsion chamber 32. The liquid propellant accelerates the abrasive as it propels it through the propellant outlet bore 24 along the propulsion axis to strike and clean a desired surface.

Referring to FIG. 3, it has been found advantageous to maintain the stream of propellant and abrasive at approximately 30° to the surface 90 to be cleaned. More particularly, it has been found that the rate of movement of the nozzle 10 across a pipe or surface 90 must be much slower for angles greater than 30°. Similarly, it has been found that for angles less than 30°, the cleaning effect is not as great and multiple passes are required.

Also, in the preferred embodiment, the nozzle 10 is fixed to rigid lances 53 and 73 and moved across the surface to be cleaned. It should be understood, however, that the nozzle 10 may be fixed in place and the rigid lances 53 and 73 may be eliminated for alternative applications, such as when the article to be cleaned is to be moved relative to the fixed nozzle.

The instant invention has been disclosed in connection with a specific embodiment. However it will be apparent to those skilled in the art that variations for the illustrated embodiment may be undertaken without departing from the spirit and scope of the invention. For example, the nozzling member 36 may be formed integrally within the propellant inlet bore 19. It should be understood, however, that such would eliminate the replaceable feature of the present nozzle insert 36. Also, the abrasive feed axis could be shifted off the reference axis to align more closely with the propulsion axis. These and other variations will be apparent to those skilled in the art and are within the spirit and scope of the present invention.

What is claimed is:

1. An improved method for propelling abrasive with high pressure water comprising the steps of, applying a substantially constant flow rate of air and abrasive particles to an abrasive inlet of a body having a propulsion chamber disposed therein, said abrasive inlet communicating with said propulsion chamber via a substantially straight first path from outside said body to inside said body which defines an abrasive axis in said chamber with said propulsion chamber being formed as a a direct extension of the abrasive path along said straight line abrasive axis, applying high pressure water from a high pressure water supply which is independent of said air and abrasive supply to a water inlet of said body, said water inlet communicating with said propulsion chamber via a substantially straight second path which defines a water axis in said chamber, said abrasive axis and said water axis intersecting each other within said propulsion chamber, accelerating said water in a propelling jet along said water axis toward an outlet bore of said propulsion chamber, said outlet bore being in substantial alignment with said water axis of said chamber, and impacting said flow of abrasive particles with said propelling jet of water within said propulsion chamber thereby increasing the energy of said abrasive particles and directing them in a high energy jet through said outlet bore.

2. The method of claim 1 wherein said flow rate of air and abrasive particles is within the range of 3,000 feet per minute to 20,000 feet per minute.

3. The method of claim 2 wherein said water is applied to said water inlet at a pressure within the range of 1,000 psi to 20,000 psi.

4. Apparatus for abrasive cleaning comprising, a body, a propulsion chamber disposed within said body, an abrasive path from outside said body through said body and opening into said chamber, said abrasive path characterized by a straight line abrasive axis from outside said body to inside said body with said propulsion chamber being formed as a direct extension of the abrasive path along said straight line abrasive axis, a water path through said body and opening into said chamber along a water axis in said chamber, said abrasive axis and said water axis intersecting one another within said propulsion chamber, an outlet bore through said body communicating with said chamber, water supply means for supplying water at high pressure to said water path, air and abrasive supply means independent of said water supply means for supplying a substantially constant flow rate of air and abrasive particles to said abrasive path, and means disposed in said water inlet for accelerating said water in a propelling jet toward said outlet bore in substantial alignment therewith so as to impact said flow of abrasive particles thereby increasing the energy of said particles and directing them in a high energy jet through said outlet bore.

5. The apparatus of claim 4 wherein, said abrasive axis and said water axis intersect each other at an acute angle.

6. The apparatus of claim 4 wherein said water supply provides water to said water path at a pressure within the range of 1,000 psi to 20,000 psi.

7. The apparatus of claim 6 wherein said air and abrasive supply means provides a flow rate of air and abrasive to said abrasive path within a range of 3,000 feet per minute to 20,000 feet per minute.

8. Apparatus for abrasive cleaning comprising, a body, a propulsion chamber disposed within said body, an abrasive path from outside said body through said body and opening into said chamber, said abrasive path characterized by a straight line abrasive axis from outside said body to inside said body with said propulsion chamber being formed as a direct extension of the abrasive path along said straight line abrasive axis, a water inlet through said body communicating with said chamber, an outlet bore through said body communicating with said chamber, water supply means for supplying water at high pressure to said water inlet, air and abrasive supply means independent of said water supply means for supplying a substantially constant flow rate of air and abrasive particles to said abrasive path, and means disposed in said water inlet for accelerating said water in a propelling jet toward said outlet bore in substantial alignment therewith so as to impact said flow of abrasive particles thereby increasing the energy of said particles and directing them in a high energy jet through said outlet bore.

* * * * *